United States Patent [19]

Zinsmeyer

[11] Patent Number: 4,531,375

[45] Date of Patent: Jul. 30, 1985

[54] PURGE SYSTEM MONITOR FOR A REFRIGERATION SYSTEM

[75] Inventor: Thomas M. Zinsmeyer, Pennellville, N.Y.

[73] Assignee: Carrier Corporation, Syracuse, N.Y.

[21] Appl. No.: 610,066

[22] Filed: May 14, 1984

[51] Int. Cl.[3] ..... F25B 43/04

[52] U.S. Cl. ..... 62/85; 62/126; 62/129; 62/157; 62/195

[58] Field of Search ..... 62/85, 195, 475, 125, 62/126, 127, 129, 157, 158, 231; 137/505.11, 551, 557, 552.7; 340/626; 165/11 R; 236/94

[56] References Cited

U.S. PATENT DOCUMENTS

| | | | |
|---|---|---|---|
| 2,986,894 | 6/1961 | Endress et al. | 62/85 |
| 3,013,404 | 12/1971 | Endress et al. | 62/195 |
| 3,276,216 | 10/1966 | Papapanu | 62/85 |
| 3,592,017 | 7/1971 | Lipman et al. | 62/85 |
| 3,688,515 | 9/1972 | Lavigne, Jr. | 62/85 |
| 3,710,585 | 1/1973 | Dillenbeck et al. | 62/85 |
| 4,267,705 | 5/1981 | Leonard et al. | 62/195 |
| 4,299,095 | 11/1981 | Cassarino | 62/158 X |
| 4,304,102 | 12/1981 | Gray | 62/195 |
| 4,307,775 | 12/1981 | Saunders et al. | 165/11 R |
| 4,325,223 | 4/1982 | Cantley | 62/126 |
| 4,407,138 | 10/1983 | Mueller | 62/126 |

OTHER PUBLICATIONS

Carrier Corporation "Start-Up, Operation and Maintenance Instructions-190k" pp. 25-26.

*Primary Examiner*—Harry Tanner
*Attorney, Agent, or Firm*—Douglas L. Miller

[57] ABSTRACT

A refrigeration system is disclosed having a purge system with means for monitoring operation of the purge system and for taking corrective action in response to excessive purge system operation. Preferably, the monitoring means is a microcomputer control system for monitoring purge pump operation to determine if the purge pump has operated continuously for a period of time greater than a predetermined amount of time. If the purge pump has operated continuously for a period of time greater than the predetermined amount of time, then the microcomputer control system overrides normal purge pump operation and maintains the purge pump inoperative for a selected time period before attempting to resume normal operation. The microcomputer control system counts the number of consecutive times that normal purge pump operation is overridden and totally disables the purge system if the number of consecutive overrides exceeds a preselected number.

4 Claims, 2 Drawing Figures

PURGE SYSTEM MONITOR FOR A REFRIGERATION SYSTEM

BACKGROUND OF THE INVENTION

This invention relates to refrigeration systems and, more particularly, relates to purge systems for removing noncondensible gases and other contaminants from refrigeration systems.

Within refrigeration systems various noncondensible gases and other contaminants normally become mixed with refrigerant used in the refrigeration system and tend to collect at some point in the refrigeration system such as at the top of a condenser in a vapor compression refrigeration system. The presence of noncondensible gases and other contaminants in a refrigeration system reduces the efficiency of the refrigeration system since, for example, their presence necessitates higher condenser pressures with accompanying increases in power costs or in the amount of cooling fluid, such as relatively cold water, used to condense refrigerant in the condenser. The capacity of the refrigeration system is also reduced since the noncondensible gases displace refrigerant vapor flowing through the refrigeration system.

To overcome the foregoing described disadvantages, purging devices of various types may be used to remove or purge noncondensible gases and other contaminants from refrigeration systems. Such purging devices normally include a purge chamber for collecting the noncondensible gases, such as air, and for expelling them to the atmosphere. The gases which collect in the purge chamber also include water vapor and some refrigerant vapor. Usually a heat transfer coil is located within the purge chamber and is supplied with a cooling fluid, such as water or refrigerant. The heat transfer coil operates as a condensing coil to condense the refrigerant and water vapor to a liquid in the purge chamber. Then, these condensed liquid constituents, such as the refrigerant and the water, are removed from the purge chamber. Typically, the condensed liquid refrigerant is recirculated to the refrigeration system and the condensed water is expelled from the refrigeration system. The noncondensible gases are usually vented to the atmosphere by an automatic pump which operates in response to a pressure differential between the purge chamber and the condenser of the refrigeration system.

In purge systems of the type described above, if the purge pump operates excessively or malfunctions then undesirable amounts of refrigerant may be expelled to the environment. When using such purge systems, it is highly desirable to minimize the amounts of refrigerant expelled to the environment since refrigerant is expensive to replace in the refrigeration system and is an undesirable contaminant in the environment.

SUMMARY OF THE INVENTION

Therefore, it is an object of the present invention to improve the operation of automatic purge systems used to remove noncondensible gases and other contaminants from refrigeration systems.

Another object of the present invention is to operate an automatic purge system in a refrigeration system to prevent undesirable amounts of refrigerant from the refrigeration system being expelled to the environment due to excessive operation or malfunction of the purge system.

These and other objects of the present invention are attained by providing a refrigeration system with a purge system including means for monitoring operation of the purge system and for taking corrective action in response to excessive operation or malfuction of the purge system. The monitoring means comprises a processor means, such as a microcomputer, for detecting a signal indicative of purge system operation and for processing this signal to determine if the purge system has operated continuously for a period of time greater than a predetermined amount of time. If the processor means determines that the purge system has operated continuously for a period of time greater than the predetermined amount of time then an override control signal is provided by the processor means to the purge system to discontinue operation of the purge system for a selected period of time after which normal operation of the purge system is resumed. The processor means further includes means for counting the number of consecutive override control signals generated by the processor means, and means for preventing discontinuance of a given ongoing override control signal if the counted number of override control signals exceeds a preselected number. The processor means may also include means for displaying a signal indicative of excessive purge system operation which is actuated, for example, when the number of consecutive override control signals generated by the processor means exceeds the preselected number.

BRIEF DESCRIPTION OF THE DRAWINGS

Other objects and advantages of the present invention will be apparent from the following detailed description in conjunction with the accompanying drawings, wherein like reference numerals identify like elements, and in which.

DESCRIPTION OF THE PREFERRED EMBODIMENT

Figure 1:
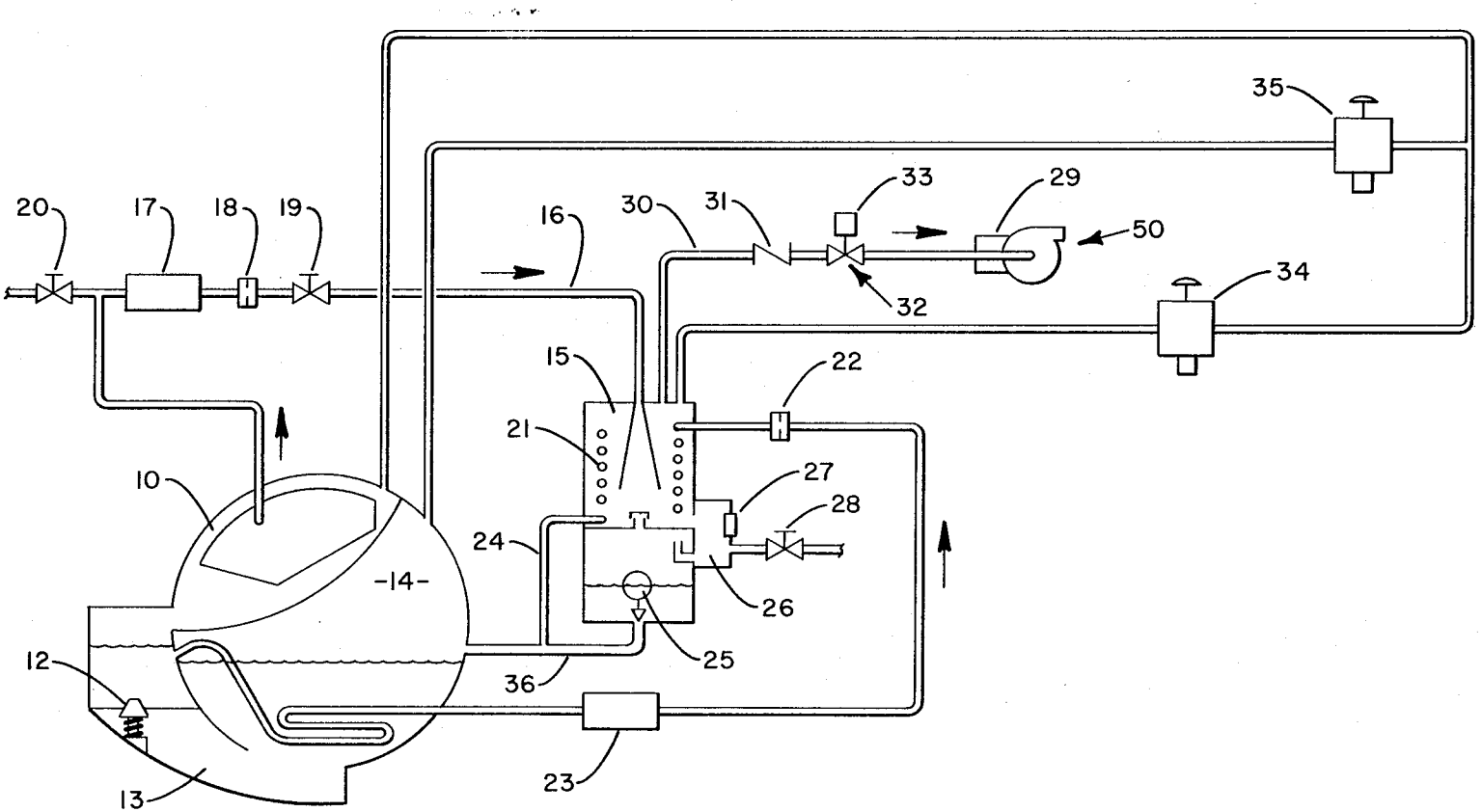
FIG. 1 is a schematic illustration of a refrigeration system with a purge system which may be operated according to the principles of the present invention.

Referring to FIG. 1, there is a schematic illustration of a refrigeration system with a purge system which may be operated according to the principles of the present invention. The refrigeration system illustrated in FIG. 1 is a typical vapor compression refrigeration system wherein refrigerant is compressed by a compressor (not shown) and discharged into a condenser 10. The condenser 10 discharges liquid refrigerant condensed in the condenser 10 to an expansion device 12, such as a poppet valve, float valve, or simple orifice, which supplies liquid and vaporized refrigerant through a conduit 13 to evaporator 14 of the refrigeration system. Liquid refrigerant in the evaporator 14 is evaporated to cool a heat transfer fluid, such as water, flowing through heat transfer tubing (not shown) in the evaporator 14. Evaporated refrigerant from the evaporator 14 is discharged through a discharge line (not shown) to the suction side of the compressor where the refrigerant begins another refrigeration cycle.

Various noncondensible gases and other contaminants normally become mixed with the refrigerant within the refrigeration system and accumulate in the condenser 10. To purge the refrigeration system without losing refrigerant, it is necessary to separate the noncondensible gases and other contaminants from the refrigerant. A purge chamber 15 is provided for this purpose. The purge chamber 15 is connected with the condenser 10 by a conduit 16 for extracting a gaseous mixture from the condenser 10 and conveying it to the purge chamber 15. This gaseous mixture entering the purge chamber 15 will normally be a mixture of noncondensible gases, refrigerant vapor and water vapor.

Conduit 16 has a strainer 17 to remove any particulate matter which may be entrained in the gaseous mixture from the condenser and an orifice 18 to regulate the flow of vapor between the condenser 10 and the purge chamber 15. Also, the conduit 16 includes a normally open valve 19 which may be manually operated to isolate the purge system from the refrigeration system under certain circumstances, such as when the refrigeration system is pressurized through valve 20 for leak testing the refrigeration system. It should be noted that valve 20 is closed during normal operation of the purge and refrigeration systems.

A condensing coil 21 is located in the top portion of the purge chamber 15 to receive cool fluid used to condense the refrigerant vapor which is provided to the purge chamber 15. The condensing coil 21 may receive cool fluid from any of a variety of sources such as from an external water supply, from a separate refrigeration system or, as shown in FIG. 1, from the condenser 10 of the same refrigeration system. An orifice 22 is provided in the inlet line to the condensing coil 21 to reduce refrigerant pressure when liquid refrigerant is supplied from the condenser 10 to the condensing coil 21 as shown in FIG. 1. Also, as shown in FIG. 1, a filter 23 is provided to remove any particulate matter which may be in the refrigerant flowing from the condenser 10 to the condensing coil 21. Further, in FIG. 1, it should be noted that the refrigerant from the condensing coil 21 is returned to the evaporator 14 through refrigerant outlet line 24.

The cool fluid circulating through the condensing coil 21 in the purge chamber 15 lowers the temperature of the gaseous mixture of refrigerant, noncondensibles and other contaminants collected in the purge chamber 15 to condense the refrigerant vapor and other condensibles such as water vapor. The less dense condensibles such as water collect as a layer on top of the relatively pure liquid refrigerant condensed in the purge chamber 15. Within the purge chamber 15 is a float valve 25 to control the level of liquid refrigerant in the purge chamber 15. As the liquid level rises in the chamber 15 the float valve 25 automatically opens to discharge substantially pure liquid refrigerant from the chamber 15 to the evaporator 14 through line 36, and as the liquid level in the purge chamber 15 drops below a predetermined level the float valve 25 closes. An intermediate chamber 26 is provided for separating condensed water from condensed refrigerant. Liquid refrigerant from the intermediate chamber 26 is allowed to pass to the bottom portion of the purge chamber 15 where the float valve 25 is located. Water, being a lower density liquid than refrigerant, is trapped in the upper part of the intermediate chamber 26. A side wall of the intermediate chamber 26 is provided with a sight glass 27 which permits one to determine by visual observation the level of water within the intermediate chamber 26. A manual valve 28 is also arranged on the side wall of the intermediate chamber 26 to drain off the accumulated water.

The noncondensible gases, such as air, collect in the upper part of the purge chamber 15. As the noncondensible gases accumulate, the pressure in the purge chamber 15 rises approaching the pressure of the condenser 10. In order to expell the noncondensible gases, a purge pump 50 driven by an electric motor 29 is connected with the purge chamber 15 by a line 30. The line 30 includes a check valve 31 and a solenoid operated valve 32, with a solenoid coil 33, for controlling the flow of noncondensible gases to the purge pump 50.

As further shown in FIG. 1, the purge system also includes a normally closed purge operating switch 34, which is a differential pressure switch responsive to the difference in pressure between the purge chamber 15 and the condenser 10, and a normally open purge safety switch 35, which is a differential pressure switch responsive to the difference in pressure between the condenser 10 and the evaporator 14. These switches 34, 35 are part of a control system for the purge system, which will be described in more detail hereinafter.

Figure 2:
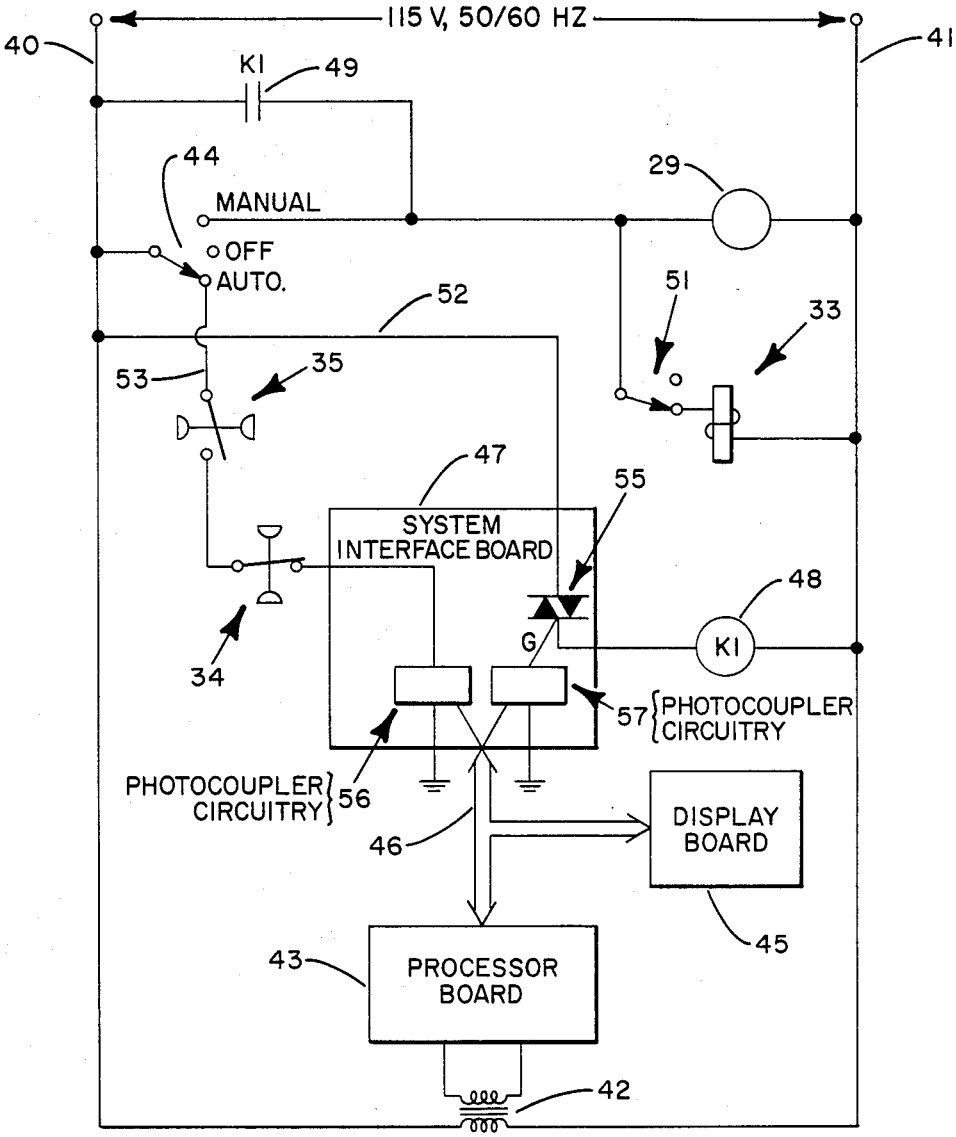
FIG. 2 is a schematic illustration of a control system for operating the purge system shown in FIG. 1 according to the principles of the present invention.

Referring to FIG. 2, a control system for operating the purge system illustrated in FIG. 1 according to the principles of the present invention is shown. An operating switch 44 is provided for switching the control system between a manual, an off, and an automatic mode of operation. Electrical power is supplied to the control system through electrical lines 40 and 41 which are connected across a power supply (not shown) such as a 115 volt, 50 or 60 Hertz (Hz) alternating current (AC) power supply. Electrical power is supplied from the power supply through a transformer 42 to a processor board 43 which preferably includes a microcomputer such as a model 8031 microcomputer available from Intel Corporation having a place of business at Santa Clara, Calif. The processor board 43 is connected with a system interface board 47 and a display board 45 through an interconnector 46 such as a ribbon cable. Electrical power is also supplied from electrical line 40 through an electrical line 52 directly to the system interface board 47. The system interface board 47 includes at least one switching device, preferably a triac switch 55, such as a model SC-140 triac available from CTS, Inc. having a place of business at Skyland, N.C. The triac switch 55 on the system interface board 47 is electrically connected to control the supply of electrical power from the electrical line 52 to relay 48. The triac switch 55 is opened and closed in response to electrical signals supplied to gate G of the triac switch 55 from photocoupler circuitry 57 on the system interface board 47. The photocoupler circuitry 57 is controlled by control signals supplied via the interconnector 46 from the processor board 43 to the photocoupler circuitry 57 on the system interface board 47. Primarily, the photocoupler circuitry 57 is provided to isolate the processor board 43 from the 115 volt power supply while allowing the processor board 43 to control the triac switch 55.

The display board 45 comprises a visual display including, for example, light emitting diodes (LED's) or liquid crystal display (LCD's) devices arranged to provide a multi-digit display which is under the control of the processor board 43.

As shown in FIG. 2, the purge operating switch 34 and the purge safety switch 35 are electrically connected in series to the system interface board 47. A photocoupler circuit 56 on the system interface board 47 is electrically connected to provide an output signal through the ribbon connector 46 to the processor board 43 when the switches 34, 35 are both closed to provide the 115 volt power supply voltage from the electrical line 40 through an electrical line 53 to the system interface board 47. Again, as with the photocoupler circuitry 57, the primary purpose of the photocoupler circuitry 56 is to isolate the processor board 43 from the 115 volt power supply connected across the power supply lines 40, 41. In this regard, it should be noted that each of the circuits 56, 57 may be an optically isolated triac triggering circuit or other such suitable circuit as will be readily apparent to one of ordinary skill in the art to which the present invention pertains.

Also, as shown in FIG. 2, the solenoid coil 33 of the solenoid operated valve 32 is electrically connected in parallel with the purge pump motor 29. Also, as shown in FIG. 2, both the purge pump motor 29 and the solenoid coil 33 are electrically connected to a normally open relay contact 49 which is controlled by operation of the relay 48. The normally open relay contact 49 and the operating switch 44 are electrically connected in parallel as shown in FIG. 2. Further, as shown in FIG. 2, a solenoid switch 51 is electrically connected in series with the solenoid coil 33. The solenoid switch 51 is closed during normal automatic operation of the purge system. The solenoid switch 51 is provided only to allow manual control of the solenoid coil 33 in certain situations such as during initial startup of the refrigeration system or when servicing or testing the purge and/or refrigeration systems.

In operation, when the operating switch 44 is switched to the manual mode of operation, electrical power is supplied to the purge pump motor 29 to continuously run the purge pump independently of other elements of the control system. This mode of operation is desirable only in certain special situations such as during initial startup of the refrigeration system or when servicing or testing the purge and/or refrigeration systems.

When the operating switch 44 is switched to the off mode of operation, electrical power is sufficiently cut off from the control system to render the control system inoperative. Again, this mode of operation is desirable only in certain special situations such as during initial startup of the refrigeration system or when servicing or testing the purge and/or refrigeration systems.

When the operating switch 44 is switched to the automatic mode of operation, the control system provides automatic control of the operation of the purge system. This is the usual mode of operation when the refrigeration system is operating under normal circumstances. In this automatic mode of operation, electrical power is supplied from the power supply through electrical lines 40 and 41 and through the transformer 42 to the processor board 43 thereby activating the processor board 43. Also, electrical power is supplied from the power supply through the electrical line 52 to the system interface board 47. Electrical power is also available to the purge safety switch 35 and the purge operating switch 34 via electrical line 53.

In the automatic mode of operation, at startup of the refrigeration system, the purge operating switch 34 is normally closed and the purge safety switch 35 is normally open since the pressure differences necessary to change the positions of these switches 34, 35 are not present in the refrigeration system. Therefore, at startup, normally no electrical power is supplied through electrical line 53 to the photocoupler circuitry 56 on the system interface board 47. Thus, no output signal from the system interface board 47 is supplied to the processor board 43 and, in response, the processor board 43 operates to maintain the triac switch 55 on the system interface board 47 open so that the relay 48 is inactive and the associated relay contacts 49 are open. With the relay contacts 49 open, the solenoid coil 33 and the purge pump motor 29 are also inactive.

When the condenser 10 and the evaporator 14 reach their normal operating pressures there will be a sufficient pressure difference between them to close the purge safety switch 35. These normal operating pressures will also cause the purge operating switch 34 to open thereby maintaining the solenoid coil 33 and the purge pump motor 29 in their inactive state. However, after a sufficient time period of operation, enough noncondensible gases will accumulate in the purge chamber 15 to cause a decrease in the pressure differential between the purge chamber 15 and the condenser 10 sufficient to close the purge operating switch 34. With the purge operating switch 34 and the purge safety switch 35 both closed, electrical power is supplied to the photocoupler circuitry 56 on the system interface board 47 thereby providing an output signal to the processor board 43 which, in turn generates a control signal which causes the triac switch 55 on the system interface board 47 to close. In this manner, the relay 48 is energized causing the associated relay contact 49 to close. Thus, electrical power is supplied to the purge pump motor 29 and to the solenoid coil 33 of the solenoid operated valve 32 thereby resulting in noncondensible gases being pumped by the purge pump 50 out of the purge chamber 15 to the atmosphere thereby lowering the pressure in the purge chamber 15.

When the pressure in the purge chamber 15 is lowered by operation of the purge pump 50 to a level sufficient to open the purge operating switch 34, electrical power to the photocoupler circuitry 56 on the system interface board 47 is discontinued and, in response thereto, the processor board 43 generates a control signal to open the triac switch 55 on the system interface board 47. Thus, the relay 48 is de-energized thereby opening the associated relay contact 49 which causes operation of the purge pump motor 29 to cease and causes the solenoid operated valve 32 to close. The foregoing operating sequence is repeated each time noncondensible gases build up sufficiently in the purge chamber 15 to cause the purge operating switch 34 to close.

Throughout operation of the refrigeration system the purge safety switch 35 continuously monitors the pressure difference between the condenser 10 and evaporator 14 so that if this pressure difference falls below a selected level the purge safety switch 35 opens thereby preventing operation of the purge pump 50. This feature prevents operation of the purge pump 50 during certain time periods when it is not desirable to operate the purge system such as when the refrigeration system is idle. This feature also eliminates the potential for continuous purge system operation when the refrigeration system is operating at low lift. However, this feature provides no protection against certain failures such as a failure in the purge system itself.

The processor board 43 monitors operation of the purge system by sensing whether or not a control signal is being supplied to the gate G of the triac switch 55 to determine whether electrical power is being supplied through the triac switch 55 on the system interface board 47 to the relay 48. Using this information, the processor board 43 is programmed to determine how long the purge pump motor 29 is operated during any purge cycle. If the processor board 43 determines that the purge pump motor 29 has run continuously for a period of time greater than a first predetermined amount of time, for example, 15 seconds, then the processor board 43 generates an override control signal which is supplied to the triac switch 55 on the system interface board 47 to open the triac switch 55 thereby discontinuing the flow of electrical power to the relay 48 which in turn opens the relay contact 49 to de-energize the purge pump motor 29 and the solenoid coil 33 thereby shutting down operation of the purge pump 50 and closing the solenoid actuated valve 32. The processor board 43 is programmed to maintain the triac switch 55 open for a second predetermined amount of time, for example, 10 minutes, and may cause a signal to be displayed on the display board 45 to alert an operator of possible excessive purge pump operation. After expiration of this second predetermined amount of time the processor board 43 will discontinue the override control signal and permit the triac switch 55 to close thus allowing the purge system to return to its normal automatic mode of operation. The processor board 43 is also programmed to count the occurrence of an override control signal and to store in memory the information that an override signal has been generated and supplied to the system interface board 47.

After an override control signal has been generated and supplied to the system interface board 47, the processor board 43 will continue to monitor operation of the purge system by determining whether electrical power is being supplied through the triac switch 55 on the system interface board 47 to the relay 48. If excessive purge system operation is again detected by the processor board 43, without any proper purge cycle having occurred in the interim, another override control signal will be generated by the processor board 43 and supplied to the system interface board 47. Again, after a predetermined time interval, the processor board 43 will return the purge system to its normal automatic mode of operation and the counter of the processor board 43 will be incremented by one. The counter is cleared if a proper purge cycle does occur between occurrences of excessive purge system operation. The foregoing operating sequence will continue until the processor board 43 determines that the number of consecutive override control signals generated and supplied by the processor board 43 to the system interface board 47 has exceeded a preselected number which is programmed into the memory of the processor board 43. If this preselected number is exceeded, then the processor board 43 will generate and supply a continuous override control signal to the system interface board 47 to continuously maintain the triac switch 55 open thereby totally disabling the purge system. Also, the processor board 43 will cause an alarm signal to be displayed on the display board 45 to alert an operator of the excessive purge system operation.

In the foregoing manner, the control system shown in FIG. 2 insures that excessive purge system operation does not occur thereby preventing undesirable amounts of refrigerant from being expelled from the refrigeration system to the atmosphere by improper operation of the purge system. Also, this control system operates to allow controlled purge system operation, even after possible excessive periods of purge system operation are detected, to provide an opportunity for the purge system to resume normal operation before totally disabling the purge system.

Of course, the foregoing description is directed to one particular embodiment of the present invention and various modifications and other embodiments of the present invention will be readily apparent to one of ordinary skill in the art to which the invention pertains. Therefore, while the present invention has been described in conjunction with a particular embodiment it is to be understood that various modifications and other embodiments of the present invention may be made without departing from the scope of the invention as described herein and as claimed in the appended claims.

What is claimed is:

1. A refrigeration system having a purge system for removing noncondensible gases from the refrigeration system comprising:

switch means for turning the purge system on and off in response to control signals provided to said switch means when the purge system is operating in an automatic mode of operation;

processor means for monitoring operation of the purge system, for detecting if the purge system has operated continuously for a period of time greater than a predetermined amount of time, and for providing an override control signal to the switch means to turn off the purge system when said processor means determines that the purge system has operated continuously for a period of time greater than the predetermined amount of time;

the processor means further comprising means for timing the override control signal provided to the switch means by the processor means and for discontinuing the override control signal after the override control signal is continuously provided to the switch means for a period of time greater than a preselected amount of time; and means for counting the number of consecutive override control signals provided to the switch means by the processor means and for preventing discontinuance of an override control signal if the number of consecutive override control signals supplied to the switch means exceeds a preselected number.

2. A refrigeration system having a purge system for removing noncondensible gases from the refrigeration system as recited in claim 1 further comprising:

means for displaying a signal indicating excessive purge system operation if the number of consecutive override control signals supplied to the switch means exceeds the preselected number.

3. A method of operating a refrigeration system having a purge system for removing noncondensible gases from the refrigeration system which comprises:

turning the purge system on and off in response to control signals provided to the purge system;

monitoring the operation of the purge system to determine whether the purge system has operated continuously for a period of time greater than a first predetermined amount of time;

providing an override control signal to the purge system to turn off the purge system for a second predetermined amount of time if it is determined that the purge system has operated continuously for a period of time greater than the first predetermined amount of time;

monitoring the number of consecutive override control signals provided to the purge system; and continuously providing an override control signal to the purge system if the monitored number of consecutive override control signals exceeds a preselected number.

4. A method of operating a refrigeration system having a purge system for removing noncondensible gases from the refrigeration system as recited in claim 3 which further comprises:

displaying a signal indicating excessive purge system operation if the monitored number of consecutive override control signals exceeds the preselected number.

* * * * *